US006729715B2

(12) United States Patent
Gonzalez

(10) Patent No.: US 6,729,715 B2
(45) Date of Patent: May 4, 2004

(54) FLUID EJECTION

(75) Inventor: Victor L. Gonzalez, Mayaguez, PR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 98 days.

(21) Appl. No.: 10/218,925

(22) Filed: Aug. 14, 2002

(65) Prior Publication Data

US 2004/0032464 A1 Feb. 19, 2004

(51) Int. Cl.[7] ..... B41J 2/05; B41J 2/205
(52) U.S. Cl. ..... 347/63; 347/62; 347/15
(58) Field of Search ..... 347/15, 48, 20, 347/56, 63, 65, 67, 62

(56) References Cited

U.S. PATENT DOCUMENTS

| | | | | |
|---|---|---|---|---|
| 4,281,333 A | | 7/1981 | Tsuzuki et al. | 347/15 |
| 5,036,337 A | | 7/1991 | Rezanka | 347/14 |
| 5,124,716 A | | 6/1992 | Roy et al. | 347/15 |
| 5,481,287 A | * | 1/1996 | Tachihara | 347/62 |
| 6,003,973 A | | 12/1999 | Kamiyama et al. | 347/48 |
| 6,146,915 A | | 11/2000 | Pidwerbecki et al. | 347/63 |
| 6,227,640 B1 | | 5/2001 | Maze et al. | 347/15 |
| 6,267,468 B1 | | 7/2001 | Torgerson et al. | 347/65 |
| 6,276,775 B1 | | 8/2001 | Schulte | 347/15 |
| 6,318,847 B1 | | 11/2001 | Wade | 347/62 |

* cited by examiner

*Primary Examiner*—Juanita Stephens

(57) ABSTRACT

A fluid ejection device according to a particular embodiment of the invention includes a base, a layer supported by the base, the layer defining an opening of variable size for containing fluid to be ejected from the fluid ejection device, a fluid driver supported by the base and adapted to eject fluid drops of different sizes from the fluid ejection device, and at least one controller operably coupled with the layer to adjust the size of the opening and operably coupled with the fluid driver to adjust the size of the ejected drops. Apparatus and method aspects according to other embodiments of the invention also are disclosed.

33 Claims, 9 Drawing Sheets

FLUID EJECTION

BACKGROUND OF THE INVENTION

A thermal inkjet printer typically includes one or more reciprocating print cartridges in which small drops of ink are formed and ejected towards a medium upon which it is desired to place alphanumeric characters, graphics, or images. Such cartridges include a printhead having an orifice plate that has a plurality of small nozzles through which the ink drops are ejected. Adjacent to the nozzles are ink firing chambers, in which ink resides prior to ejection through the nozzle. Ink is supplied to the ink-firing chambers through ink channels that are in fluid communication with an ink supply, which may be contained in a reservoir portion of the print cartridge or in a separate ink container spaced apart from the printhead.

Ejection of an ink drop through a nozzle employed in a thermal inkjet printer is accomplished by quickly heating a volume of ink within the adjacent ink firing chamber by applying an energizing electrical pulse to a heater resistor positioned in the ink firing chamber. The electrical pulse induces a temperature rise in the heater resistor, which heat energy is transferred to the ink to produce an ink vapor bubble. The rapid expansion of the ink vapor bubble forces ink through the nozzle. Once ink is ejected, the ink-firing chamber is refilled with ink from the ink channel and ink supply. The energy required to eject a drop of a given volume is referred to as turn-on energy. The turn-on energy is an amount of energy sufficient to form a vapor bubble having sufficient size to eject a predetermined amount of ink through the printhead nozzle.

The printhead includes a substrate, which is a conventional silicon wafer upon which has been grown a dielectric layer, such as silicon dioxide. The ink drops are ejected from small ink chambers carried on the substrate. The chambers (designated "firing chambers") are formed in a component known as a barrier layer. The barrier layer is made from photosensitive material that is laminated onto the printhead substrate and then exposed, developed, and cured in a configuration that defines the firing chambers.

The heater resistor for ejecting a drop is a heat transducer, such as a thin-film resistor. The resistor is carried on the printhead substrate. The resistor is covered with suitable passivation and other layers and connected to conductive layers that transmit current pulses for heating the resistors. One resistor is located in each of the firing chambers.

In a typical printhead, the orifice plate covers most of the printhead. The orifice plate may be electroformed with nickel and coated with a precious metal for corrosion resistance. Alternatively, the orifice plate is made from a laser-ablated polyimide material. The orifice plate is bonded to the barrier layer and aligned so that each firing chamber is continuous with one of the orifices.

To refill the firing chambers after each drop is ejected, each chamber is continuous with an ink channel that is formed in the barrier layer. The channels extend toward an elongated ink feed slot that is formed through the substrate. The ink feed slot may be located in the center of the printhead with firing chambers located on opposite long sides of the feed slot. The slot is made after the ink-ejecting components (except for the orifice plate) are formed on the substrate.

The above-described components (barrier layer, resistors, etc) for ejecting the ink drops are mounted to the front side of the printhead substrate. The back side of the printhead is mounted to the body of the ink cartridge so that the ink slot is in fluid communication with an opening to the reservoir. Thus, refill ink flows through the ink feed slot from the back side of the substrate toward the front of the substrate and then across the front side through the channels (and beneath the orifice plate) to refill the chambers.

Significant effort has been expended in improving print quality. Since the image output of an inkjet printer is formed of individual ink drops, the image quality and contrasts, as well as variations in image hue and lightness, are dependent on ink drop volume and ink drop distribution on the printed medium. It is known that drop volumes vary with printhead substrate temperature because the properties that control them vary with temperature: the viscosity of the ink itself and the amount of ink vaporized by a heater resistor when driven by a given electrical printing pulse. One method of controlling drop volume is to vary the electrical pulse width supplied to the heater resistor. However, inkjet ink is chemically reactive, and prolonging exposure of the heater resistor and its electrical connections to the ink may result in a chemical attack upon the heater resistor and deterioration in the long-term performance of the heater resistor. Another method of controlling drop volume is to construct a protective layer having a thickness gradient over the heater resistor. However, varying the thickness of the protective layer is subject to the tolerances of the semiconductor manufacturing process and to the tolerances in the heat conduction gradients of the protective materials.

SUMMARY OF THE INVENTION

A fluid ejection device according to a particular embodiment of the invention includes a base, a layer supported by the base, the layer defining an opening of variable size for containing fluid to be ejected from the fluid ejection device, a fluid driver supported by the base and adapted to eject fluid drops of different sizes from the fluid ejection device, and at least one controller operably coupled with the layer to adjust the size of the opening and operably coupled with the fluid driver to adjust the size of the ejected drops. Apparatus and method aspects according to other embodiments of the invention also are disclosed.

BRIEF DESCRIPTION OF THE DRAWINGS

The accompanying drawings illustrate embodiments of the present invention and together with the description serve to explain certain principles of the invention. Other embodiments of the present invention will be readily appreciated with reference to the drawings and the description, in which like reference numerals designate like parts and in which.

DETAILED DESCRIPTION OF THE PREFERRED EMBODIMENTS

Figure 1:
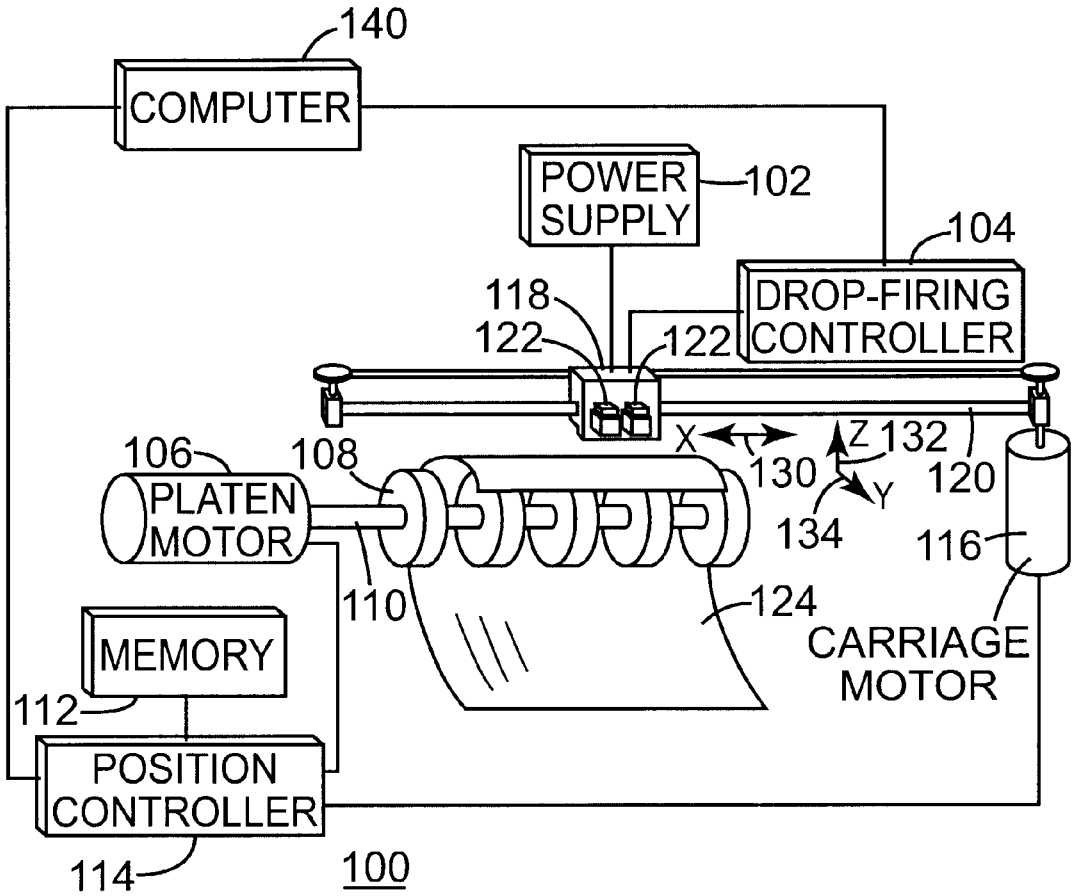
FIG. 1 is a block diagram of an inkjet printer according to an embodiment of the invention.

FIG. 1 is a block diagram of inkjet printer 100 in accordance with an embodiment of the invention. Inkjet printer 100 includes power supply 102, drop-firing controller 104 that includes a processor, for example a microcontroller or a microprocessor, platen motor 106, at least one roller 108 coupled to platen motor 106 by roller bar 110, memory 112, position controller 114 coupled to memory 112 and platen motor 106, and carriage motor 116 coupled to position controller 114, all of which are optionally under the control of computer 140 that optionally includes a microprocessor. Inkjet printer 100 further includes carriage 118 coupled to power supply 102 and drop-firing controller 104, which carriage 118 includes at least one print cartridge 122. Carriage 118 is mounted on slide bar 120, allowing carriage 118 to be reciprocated or scanned back and forth across print media 124, such as paper, by carriage motor 116. The scan axis, X, is indicated by arrow 130. Platen motor 106 and carriage motor 116 are under the control of position controller 114, which controller 114 optionally is implemented in a conventional hardware configuration and provided operating instructions from memory 112. As carriage 118 scans, ink drops are selectively ejected from each print cartridge 122 onto media 124 in predetermined print swath patterns, forming images or alphanumeric characters using dot matrix manipulation. The ink drop trajectory axis, Z, is indicated by arrow 132. The dot matrix manipulation is determined by computer 140, which computer 140 transmits instructions to drop-firing controller 104 and power supply 102. When a swath of print has been completed, media 124 is advanced an appropriate distance along the print media axis, Y, indicated by arrow 134, by platen motor 106 and roller 108 in preparation for the printing of the next swath.

Figure 2:
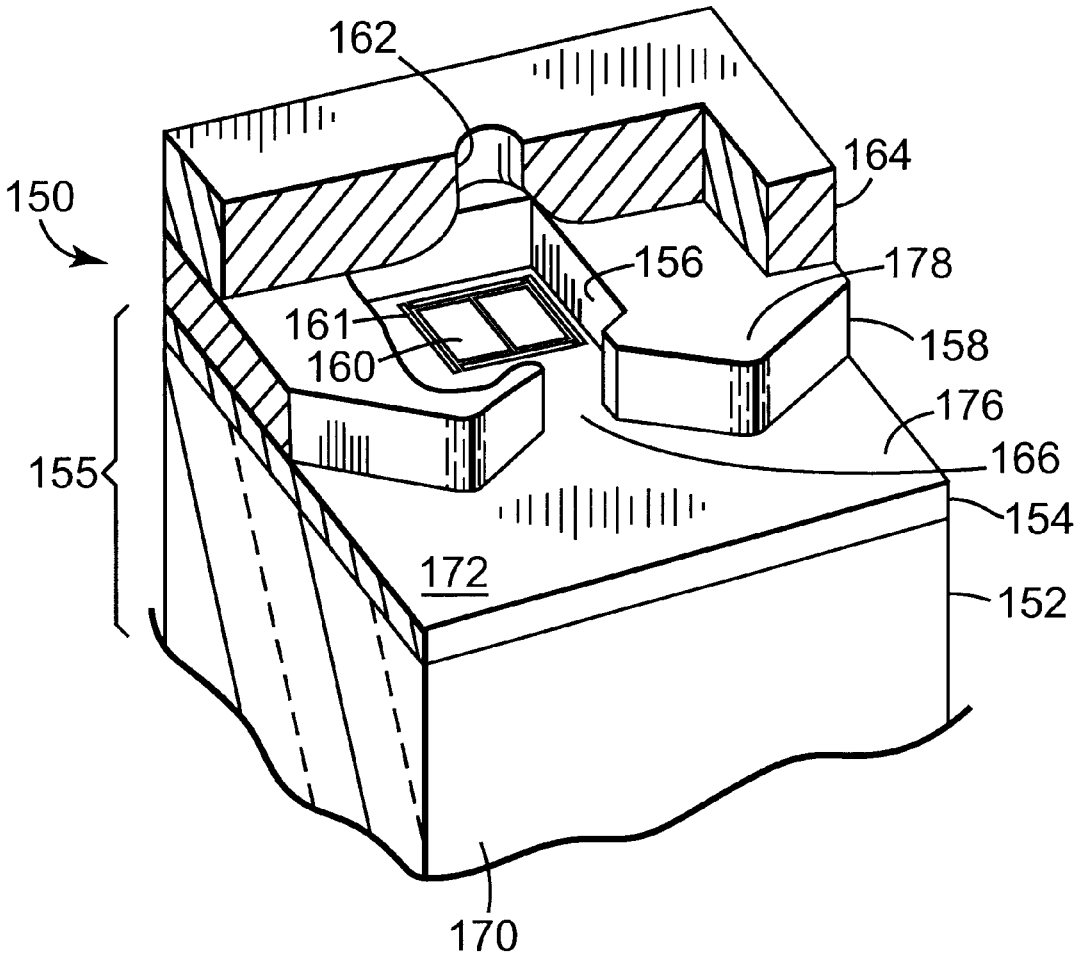
FIG. 2 is a perspective cutaway view of a portion of a printhead, showing components for ejecting ink, according to an embodiment of the invention.

With reference to FIG. 2, components of printhead 150 according to an embodiment of the invention are formed on silicon wafer 152 upon which has been grown a dielectric layer, such as silicon dioxide layer 154. The term substrate is optionally considered as including the wafer and dielectric layers. A number of printhead substrates optionally are made simultaneously on a single wafer, the dies of which each carry individual printheads.

Ink drops are ejected from small ink chambers carried on printhead substrate 155. The chambers (designated "firing chambers" 156) are formed in barrier layer 158, which is made from photosensitive material that is laminated onto printhead substrate 155 and then exposed, developed, and cured in a configuration that defines the firing chambers. The left portion of barrier layer 158 as illustrated in FIG. 2 is broken away for clarity.

A mechanism for ejecting an ink drop from firing chamber 156 includes a plurality of drivers or heaters such as thin-film resistors 160, 161. Resistors 160, 161 are carried on printhead substrate or base 155. Resistors 160, 161 are covered with suitable passivation and other layers and are connected to conductive layers that transmit current pulses for heating the resistors. One set of resistors 160, 161 is located in each of the firing chambers 156. Additional details regarding resistors 160, 161 are set forth below.

Ink drops are ejected through orifices 162 (one orifice is shown cut away in FIG. 2) that are formed in orifice plate 164 that covers most of the printhead. Orifice plate 164 optionally is made from a laser-ablated polyimide material. Orifice plate 164 is bonded to barrier layer 158 and aligned so that each firing chamber 156 is continuous with one of the orifices 162 from which the ink drops are ejected.

Firing chambers 156 are refilled with ink after each drop is ejected. In this regard, each chamber is continuous with channel 166 that is formed in barrier layer 158. Channels 166 extend toward elongated ink feed slot 170 that is formed through substrate 155. Ink feed slot 170 optionally is centered between rows of firing chambers 156 that are located on opposite long sides of ink feed slot 170. Slot 170 is made after the ink-ejecting components (except for orifice plate 164) are formed on substrate 155, according to embodiments of the invention.

The above-described components (e.g. barrier layer 158, resistors 160, 161, etc.) for ejecting ink drops are mounted to front side 172 of substrate 155. The back side of the printhead is mounted to the body of an ink cartridge so that ink slot 170 is in fluid communication with openings to a reservoir in the cartridge. Thus, refill ink flows through ink feed slot 170 from the back side of the printhead toward front side 172 of substrate 155. The ink then flows across front side 172 (that is, to and through channels 166 and beneath orifice plate 164) to fill chambers 156.

The portion of front side 172 of substrate 155 between slot 170 and ink channels 166 is shelf 176. The portions of barrier layer 158 nearest ink slot 170 are shaped into lead-in lobes 178 that generally serve to separate one channel 166 from an adjacent channel. The left lobe 178 as illustrated in FIG. 2 is partially broken away for clarity. Lobes 178 define surfaces that direct ink flowing from slot 170 across shelf 176 into channels 166. Specific examples of lead-in lobes 178 and channel shapes are shown in the figures, but other lobes and shapes will be readily apparent to those of ordinary skill upon reading this disclosure.

Figure 3:
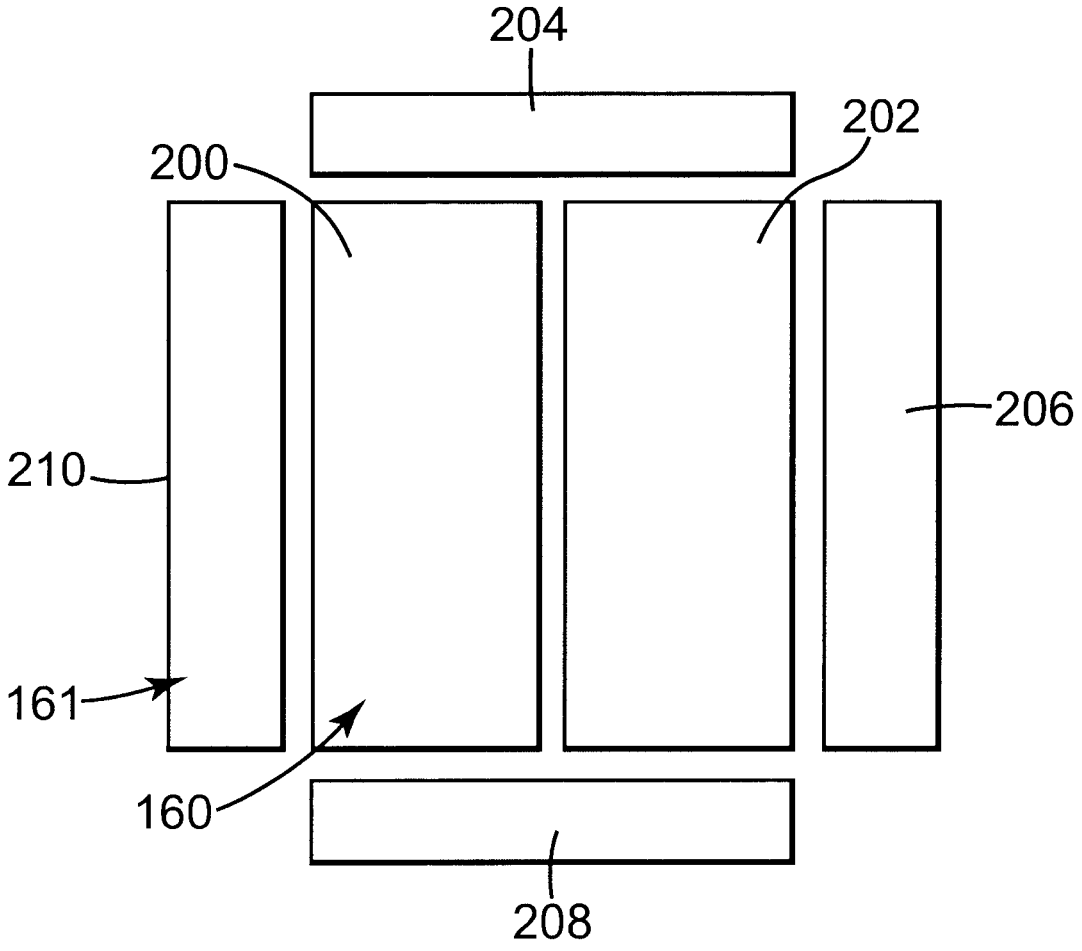
FIG. 3 is a plan view of a resistor arrangement according to an embodiment of the invention.

FIG. 3 is a top plan view of inner and outer heater resistors 160, 161 in accordance with an embodiment of the invention. Orifice plate 164 and barrier layer 158 have been deleted for clarity here. Resistors 160, 161 are realized as thin-film, generally planar structures together defining a generally square geometric figure pattern. Other geometric figures, e.g. trapezoids, polygons and other useful geometric figures are optionally also used instead of or in addition to the illustrated generally square pattern. Resistors 160, 161 in the FIG. 3 embodiment are segmented heater resistors including multiple inner heater resistor segments 200, 202 generally surrounded by multiple outer heater resistor segments 204, 206, 208, 210. Multiple electrical conductors, e.g. thin-film metallic conductors, optionally are electrically and physically coupled to one or more of heater resistor segments 200–210. Alternate fabrication techniques include resistor segments formed using vapor deposition, sputtering, or other techniques.

By selectively applying a voltage to predetermined heater resistors 160, 161, current flow is induced in all or selected ones of the heater resistor segments. Inasmuch as current flow causes a temperature increase in the heater resistor segments, at least a portion of which heat is transferred to the ink or other fluid in firing chamber 156, varying amounts of heat are transferred to the ink by varying the segments or heater resistors that are energized and hence heated. The dynamic selection of resistors 160, 161 and/or resistor segments 200–210 provides for the dynamic variation of an expelled ink drop volume as printer 100 is printing, which is highly desirable to obtain higher print quality. The dynamic selection and variation in ink drop volume also increases the number of shading combinations that are achievable, as will be described.

Figure 4:
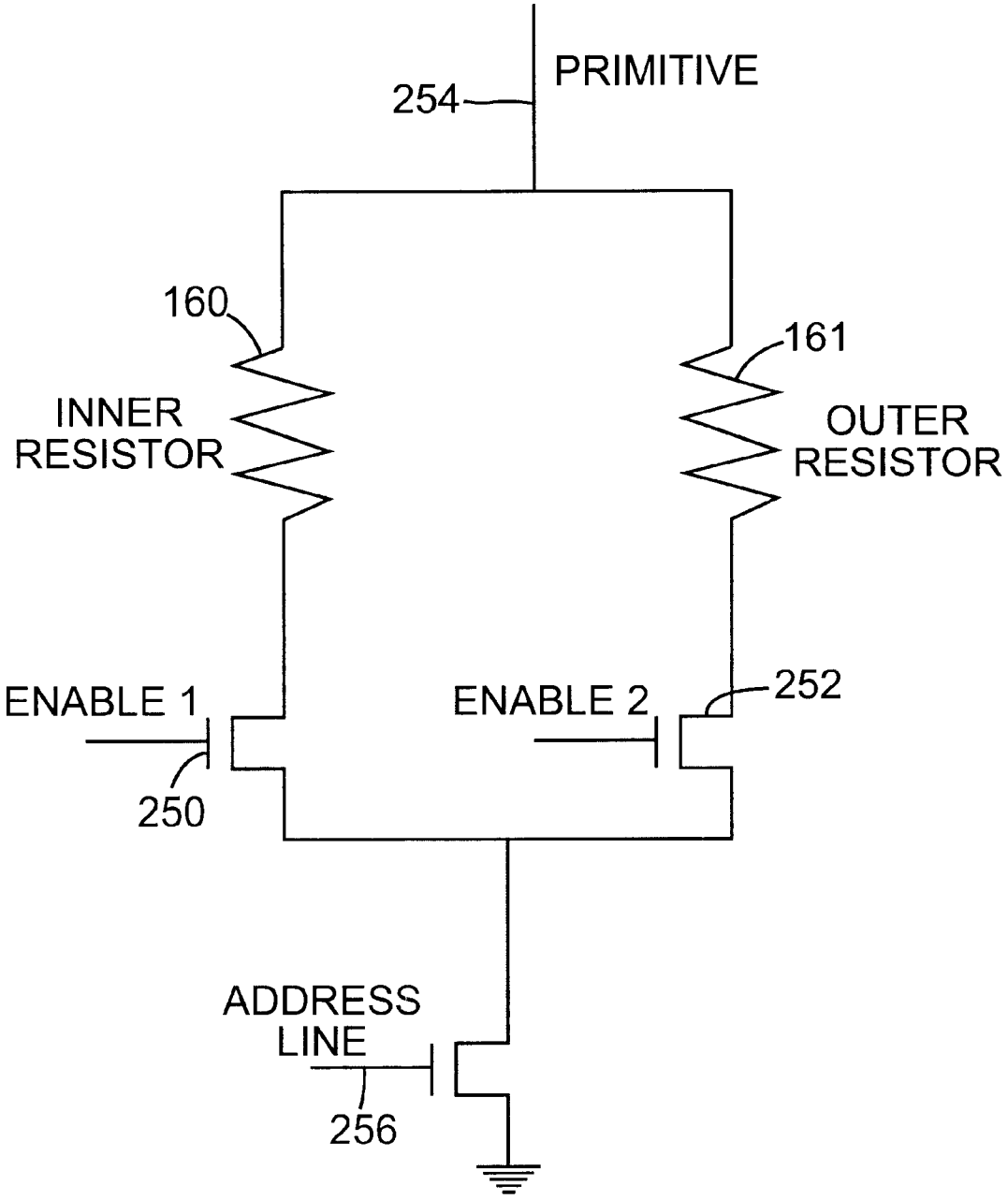
FIG. 4 is a circuit diagram according to an embodiment of the invention.

FIG. 4 is an electrical schematic diagram showing heater resistors 160, 161 connected in parallel and showing associated switching devices 250, 252, in accordance with an embodiment of the invention. Switching device 250, 252 selectively apply a voltage to one or more of resistors 160, 161. As shown in FIG. 4, resistor 160 is coupled to first switching device 250, and resistor 161 is coupled to second switching device 252. Each switching device 250, 252 includes a field effect transistor (FET), according to embodiments of the invention. Those of ordinary skill in the art will realize that many devices are optionally used to perform the switching functions of switching devices 250, 252, such as bipolar junction transistors, MOSFETs, other field effect devices, and other devices, without departing from the spirit and scope of the present invention.

Switching device 250 is coupled to drop-firing controller 104 or another controller as well as to one or more of resistors 160. Switching device 252 is coupled to drop-firing controller 104 or another controller as well as to one or more of resistors 161. Switching devices 250, 252 are also connected to primitive line 254 and address line 256, as illustrated, and to an appropriate power supply 102 or another power supply. As those of ordinary skill in the art will appreciate, specifying an address line and a primitive line uniquely identifies one particular set of resistors 160, 161. Switching devices 250, 252 optionally are included in the circuitry of inkjet cartridge 122. Alternatively, switching devices 250, 252 optionally are included in semiconductor substrate 155, in the circuitry of carriage 118, external to carriage 118 and in other circuitry of inkjet printer 100, or elsewhere.

Each switching device 250, 252 is activated in response to the receipt of a control signal, for example a gate voltage that is equal to or greater than the turn-on voltage for the switching device, from drop-firing controller 104 or other controller or processor. In brief, when each switching device 250, 252 is activated, a voltage is sourced by power supply 102, via the respective switching device, to each respective resistor 160, 161 via appropriate conductors or other connection devices. The application of a voltage in turn induces an electric current flow and the dissipation of thermal energy in each selected resistor 160, 161, more specifically in each of the heater resistor segments 200–210 that are coupled to the conductor(s) activated by the switching devices. According to embodiments of the invention, the current flows through each heater resistor segment 200, 202 of resistor 160 and/or through each heater resistor segment 204, 206, 208, 210 of resistor 162. At least a portion of the energy dissipated in each segment 200–210 is transferred to the ink or other fluid stored in firing chamber 156 to produce a drive bubble and the expulsion of fluid from chamber 156. The activation of one or both switching devices 250, 252 results in the selective application of a voltage to, and induction of an electrical current flow in, heater resistor segments 200–210 and, ultimately, a controlled variation in the volume of ink expelled from chamber 156.

According to embodiments of the invention, current flow through segments 200, 202 of heater resistor 160 as enabled by switching device 250 results in the nucleation of a drive bubble over resistor 160. The drive bubble expands and forces an ink drop from chamber 156. Current flow through all segments 200, 202, 204, 206, 208, 210 of heater resistors 160 and 161, as enabled by switching devices 250, 252, results in the nucleation of a drive bubble over both resistors 160, 161. This drive bubble, which is larger than the drive bubble produced by activation of just switching device 250, expands and forces a larger ink drop from chamber 156. Current flow through segments 204, 206, 208, 210 of heater resistor 161 as enabled by switching device 252 results in the nucleation of a drive bubble over resistor 161. By dynamically selecting activation of switching device 250, switching device 252 or both switching devices 250, 252, the size of the drop expelled by chamber 156 is dynamically adjusted. This dynamic adjustment allows for an additional level of control of variations of shading, hue and/or lightness, for example, of characters or print images on print media, without necessarily changing any electrical pulse widths or varying the thickness of the protective layer. Image quality is improved.

In terms of shading capabilities, the ability to provide two different drop sizes dramatically increases the number of available shadings. Assuming for example that up to five drops of ink can be fired, that the order of the drops is relevant, and that only one drop size is used by color, the following table indicates the significant increase in the number of color/shading possibilities that arise from having two drop sizes vs. just one drop size, without necessarily increasing dye loads or requiring additional drops.

| Five-ink color shadings | | |
|---|---|---|
| | Color Possibilities | |
| | One Drop Size | Two Drop sizes |
| 5 Drops used | 120 | 3840 |
| 4 Drops used | 120 | 1920 |
| 3 Drops used | 60 | 480 |
| 2 Drops used | 20 | 80 |
| 1 Drop used | 5 | 10 |
| Total Possible combinations | 325 | 6330 |

In addition to selecting which of resistors 160, 161 to activate, embodiments of the invention provide ways to vary the size of firing chamber 156, channel 166, and/or other components, optionally in connection with the size of drop to be ejected. Particular embodiments control barrier 158 to adjust the shape and/or size of firing chamber 156 and/or channel 166, for example. To that end, barrier 158 optionally is formed of a shape-change material according to this embodiment, e.g. a piezoelectric material that changes shape upon application of electric current. Drop-firing controller 104 controls application of electric current to barrier 158 to change its shape. More specifically, according to one example, application of electric current to barrier 158 causes barrier 158 to change the shape of firing chamber 156. The change in shape of firing chamber is correlated, according to specific embodiments, to the size of the drop being fired, i.e. to the activation of switching devices 250 and/or 252 and resistors 160 and/or 161. Embodiments of the invention provide a firing chamber size that is proportional to the size of the resistor(s) being fired. The bigger the resistor area being fired, the larger the size of firing chamber 156. Thus, if just inner resistor 160 is being activated, a smaller firing chamber 156 is used, and if both inner resistor 160 and outer resistor 161 are being activated, a larger firing chamber 156 is used. Using a piezoelectric material allows the size of the firing chamber to be modified using an electrical pulse. Additionally, as will be described, embodiments of the invention change the size of channel 166 as well.

Figure 5:
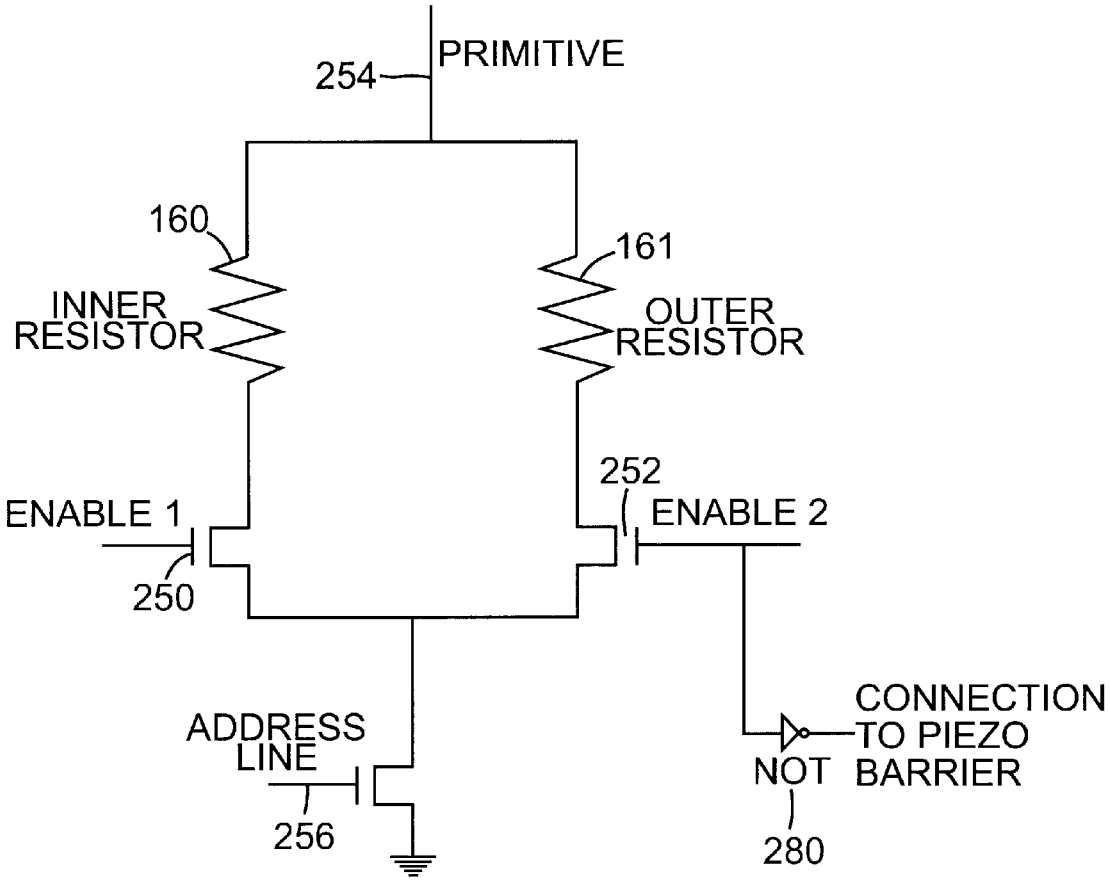
FIG. 5 is a circuit diagram according to an embodiment of the invention.

More particularly, the example of FIG. 5 shows switching device 252 electrically connected to NOT gate 280, which itself is electrically connected to barrier 158. Accordingly, when switching device 252 is activated to energize outer resistor 161, barrier 158 is not activated to contract and/or reduce the size of e.g. firing chamber 156. When only switching device 250 is activated to energize only inner resistor 160, on the other hand, switching device 252 is not activated. Barrier 158 therefore is activated, and reduces the size of e.g. firing chamber 156. As will be described, barrier 158 optionally is activated to cover outer resistor 161 when outer resistor 161 is not being fired. The smaller corresponding shape of firing chamber 156 is better suited to the relatively small drop being created and fired by inner resistor 160. Other control circuitry and/or logic control elements are contemplated as well, for example control by separate controllers or circuit components, other control components for activating barrier 158 instead of NOT gate 280, etc.

Figure 6:
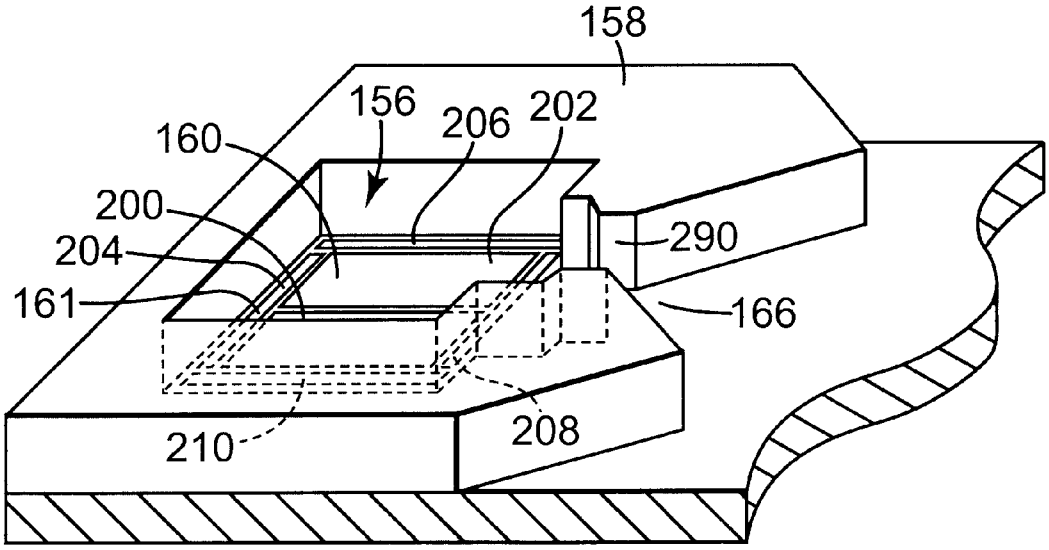
FIG. 6 is a perspective view of a portion of a printhead, according to an embodiment of the invention.
Figure 7:
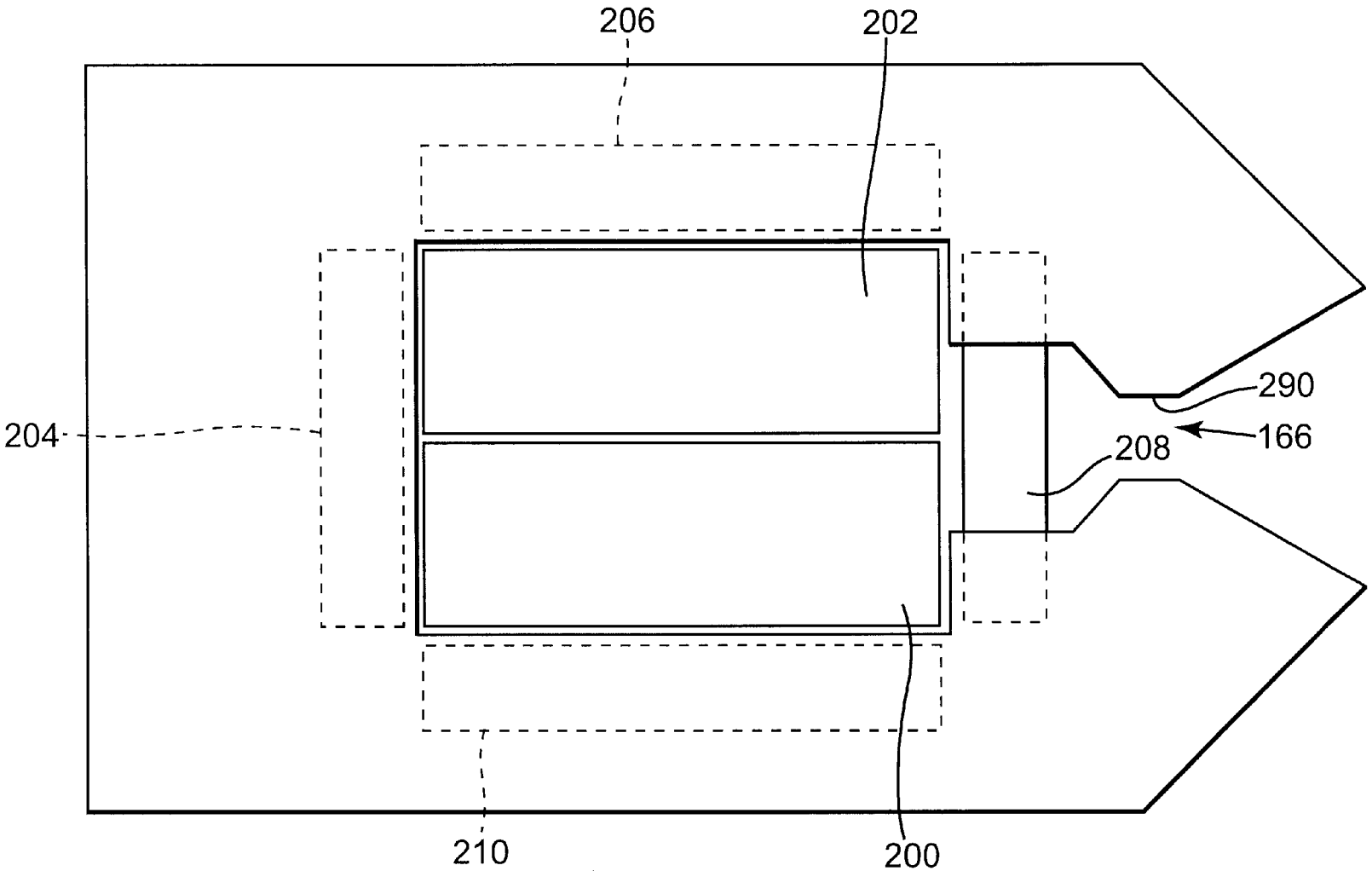
FIG. 7 is a top view of the FIG. 6 printhead in an alternative configuration, according to an embodiment of the invention.

FIGS. 6–7 are schematic diagrams showing a change in the size of firing chamber 156, according to embodiments of the invention. In FIG. 6, barrier 158 defines firing chamber 156 such that both resistors 160, 161 are exposed. In FIG. 7, on the other hand, barrier 158 has decreased the size of firing chamber 156 such that only inner resistor 160 is exposed. Outer resistor 161 is covered. Thus, for a larger drive bubble and larger drop ejection, firing chamber 156 is larger (FIG. 6). For a smaller drive bubble and smaller drop ejection, firing chamber 156 is smaller (FIG. 7). Chamber size control according to embodiments of the invention generally tends to minimize problems associated with firing a relatively small drop from a relatively large chamber, because the size of the chamber is reduced to better fit the drop. Better drop-volume control and better drop-velocity control are achieved.

FIGS. 6–7 also illustrate that changing the shape of barrier 158 optionally changes the size of channel 166. Channel 166 is wider when barrier 158 is not activated, as in FIG. 6, and is narrower when barrier 158 is activated, as in FIG. 7, according to this particular embodiment. Barrier 158 optionally is constructed and/or controlled to change the size of channel 166 either independently from or in conjunction with the changing size of firing chamber 156. Controlling the size of channel 166, especially at "pinch point" 290 thereof, effectively controls the fluid refill rate of chamber 156. Improving or adjusting the refill rate of chamber 156 at desired times presents a number of advantages, according to certain embodiments of the invention.

Figure 8:
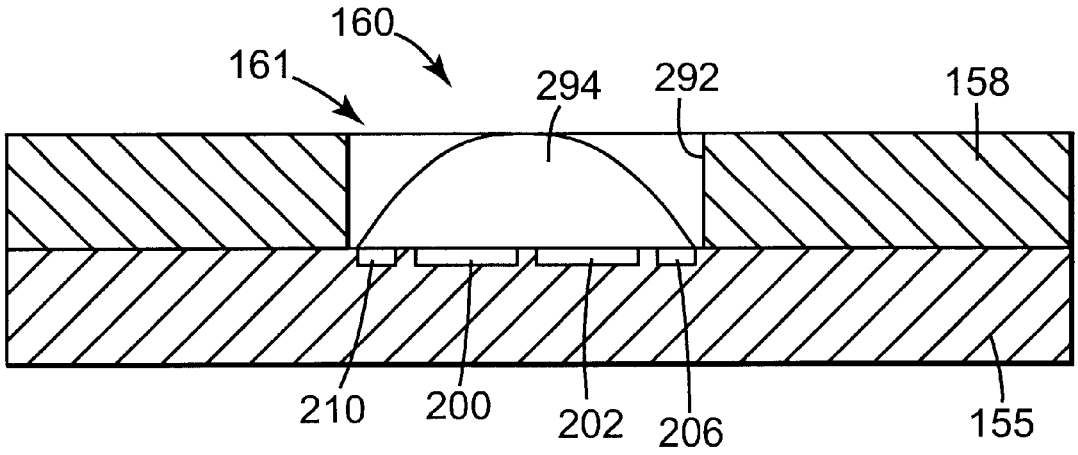
FIG. 8 is a side cross-sectional view showing formation of a large drive bubble according to an embodiment of the invention.
Figure 9:
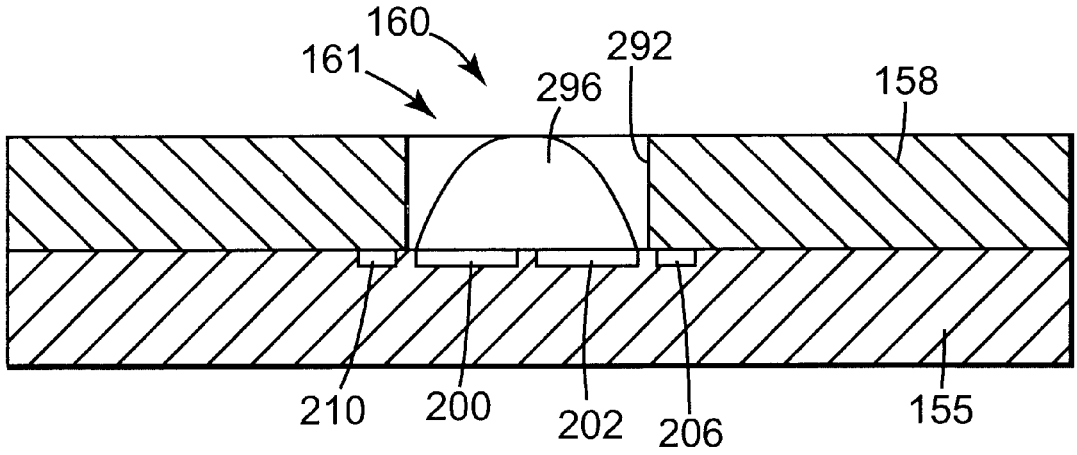
FIG. 9 is a side cross-sectional view showing formation of a small drive bubble according to an embodiment of the invention.

FIGS. 8–9 are side cross-sectional views showing formation of large and small drive bubbles according to embodiments of the invention. In FIG. 8, chamber side wall 292 formed by barrier 158 is to the outside of resistor segments 206, 210 of outer resistor 161. Both inner and outer resistors 160, 161 are activated such that large drive bubble 294 is formed across them. In FIG. 9, chamber side wall 292 formed by barrier 158 is to the inside of resistor segments 206, 210 of outer resistor 161, but still is to the outside of resistor segments 200, 202 of inner resistor 160. Just inner resistor 160 is activated, such that small drive bubble 296 is formed across segments 200, 202. For clarity, orifice plate 164 is not illustrated in FIGS. 8–9, and FIGS. 8–9 are not necessarily to scale.

Variations in the illustrated resistor layout are contemplated, according to embodiments of the invention. For example, segments 204, 206, 208 and 210 of outer resistor 161 optionally extend beyond the corners of segments 200, 202 of inner resistor 160, as shown in FIG. 1, or remain within or adjacent the corners, as illustrated in FIG. 3. The dimensions of the resistors illustrated in the drawings are not necessarily to scale; the relative sizes of the segments of resistors 160, 161 optionally are different than those shown. For example, the ratio of outer resistor area to inner resistor area depicted in e.g. FIG. 3 optionally is smaller or larger than that illustrated. A smaller outer resistor 161 reduces the distance that barrier 158 traverses upon changing the size of firing chamber 156. Additionally, resistors 160, 161 need not be segmented, according to embodiments of the invention, but can be unsegmented. Resistor sizes and/or values optionally are chosen in connection with the size of drive bubble desired, firing characteristics of the drops, size changes achieved with firing chamber 156, and/or other factors, to e.g. reduce instabilities in firing and to improve fluid-ejection quality. Too large of a gap between barrier 158 and an associated resistor such as resistor 160 and/or 161 tends to increase the difficulty in maintaining acceptable print quality, for example.

Thus, embodiments of the invention provide a printing apparatus, comprising printhead substrate 155, a plurality of heaters 160, 161 supported by printhead substrate 155 for firing drops of printing fluid, barrier 158 supported by printhead substrate 155 and defining a plurality of firing chambers 156, disposed over heaters 160, 161, barrier 158 being adapted to change shape, at least one controller 104 for activating the plurality of heaters 160, 161 and for controlling the shape of barrier 158 in association with activation of heaters 160, 161, and orifice plate 164 defining a plurality of orifices 162 over firing chambers 156, the drops being fired through orifices 162. The barrier optionally is adapted to change the size of firing chambers 156 in association with activation of heaters 160, 161. Barrier 158 also defines channels 166 for feeding printing fluid to firing chambers 156, and barrier 158 optionally is adapted to change the size of channels 166 in association with activation of heaters 160, 161 to change refill rates of firing chambers 156. Barrier 158 is formed of a shape-change material, according to specific embodiments, such as a piezoelectric material. Each heater 160, 161 comprises a plurality of individually controllable heating elements 200–210. Controller 104 is adapted to control the size of firing chambers 156 based on control of the individually controllable heating elements.

Embodiments of the invention also provide a fluid ejection device, comprising base 155 and layer 158 supported by base 155, the layer defining opening 156 and/or 166 of variable size for containing fluid to be ejected from the fluid ejection device. Fluid driver 160, 161 is supported by base 155 and is adapted to eject fluid drops of different sizes from the device. At least one controller 104 is operably coupled with layer 158 to adjust the size of the opening and is operably coupled with the fluid driver to adjust the size of the ejected drops. The opening defines firing chamber 156 for ejecting the fluid and/or channel 166 for feeding fluid into firing chamber 156 for ejection.

A method of controlling printhead 150, according to an embodiment of the invention, includes creating a drive bubble in firing chamber 156 to eject a drop of printing fluid from printhead 150, and changing the size of firing chamber 156 depending on the size of the drop and/or changing the size of refill channel 166 for the firing chamber 156. A shape-change material, such as a piezoelectric material, in the form of barrier 158 or in barrier 158 is used to change the size of firing chamber 156. According to more specific embodiments, the method includes creating a first drive bubble in firing chamber 156 with at least one first resistor 160, creating a second drive bubble in firing chamber 156 with first resistor 160 and at least one second resistor 161, the second drive bubble being larger than the first drive bubble, and changing the size of firing chamber 156 depending on whether the first drive bubble or the second drive bubble is created.

Embodiments of the invention also include one or more computer-readable media having stored thereon a computer program that, when executed by a processor, causes printhead control, printing, fluid ejection and/or the other features and capabilities described herein.

Figure 10:
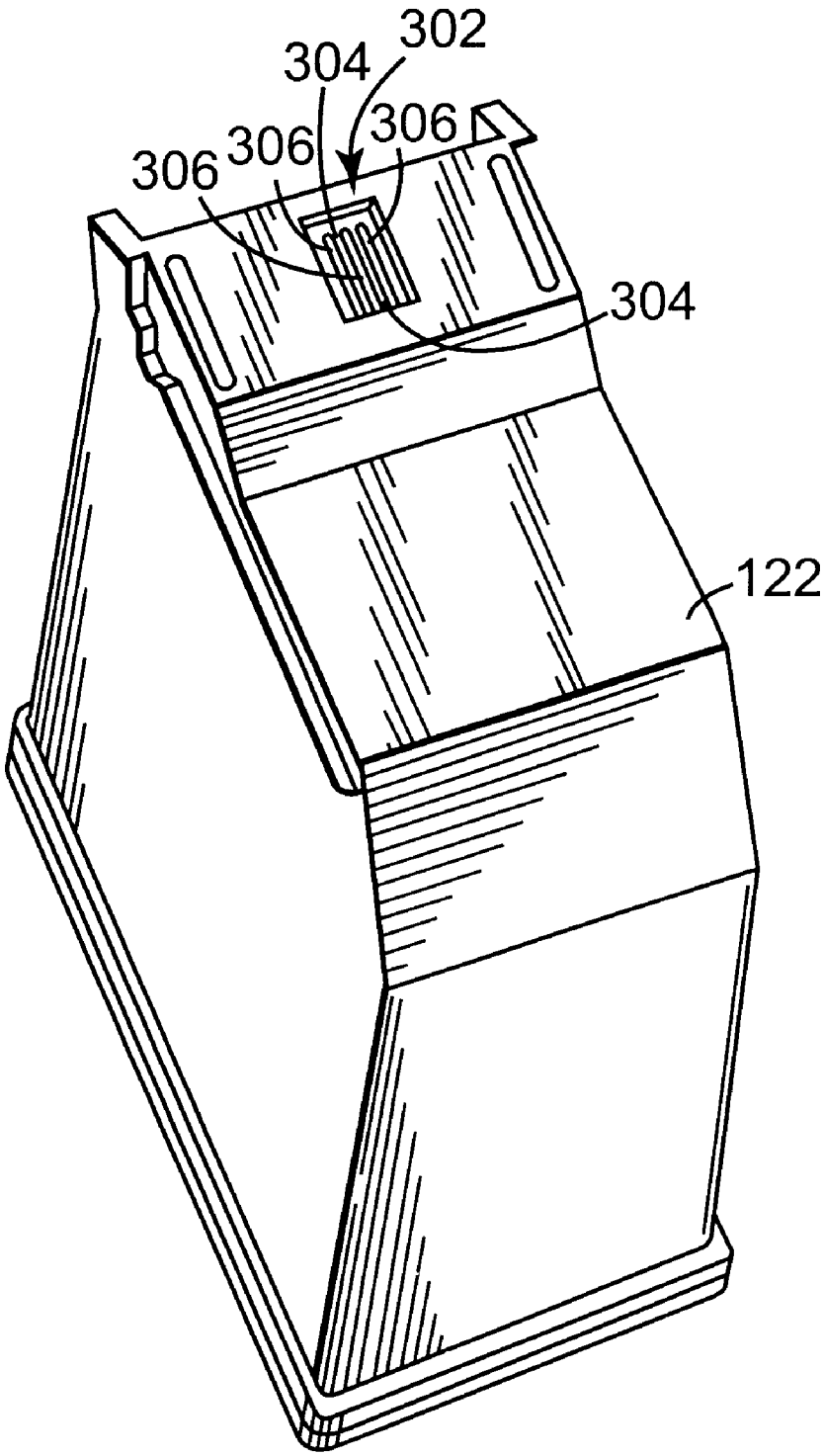
FIG. 10 is a perspective view of a print cartridge to which an inkjet printhead is attached, according to an embodiment of the invention.

FIG. 10 is a perspective view of print cartridge body 122. A lower side of substrate 155 includes structure or a surface for attachment to headland area 302 of print cartridge body 122. More particularly, according to one example, headland area 302 of print cartridge body 122 includes flanges 304 that surround ink slots 306 and e.g. match an interface pattern on the lower side of substrate 155. An adhesive bead is formed on flanges 304 of the headland area 302, for example, and printhead 150 is then pressed onto headland area 302 with the interface pattern in alignment with flanges 304. In this manner, ink slots 306 in print cartridge body 122, the adhesive, and ink feed slots 170 in printhead 150 effectively form respective conduits for transporting ink from reservoirs in print cartridge body 122 to ink channels 166 of printhead 150.

Although the present invention has been described with reference to certain embodiments, those skilled in the art will recognize that changes may be made in form and detail without departing from the spirit and scope of the invention. For example, the drawings associated with this disclosure are not necessarily to scale. Other shapes of chambers, heaters, heating elements and other components described herein are contemplated. Other applications besides printing (and fluids besides ink or other printing fluid) are contemplated. Finally, it should be understood that directional terminology, such as upper, lower, left, right, over, under, above, and below is used for purposes of illustration and description only, and is not intended necessarily to be limiting. Other aspects of the invention will be apparent to those of ordinary skill upon reading this disclosure.

What is claimed is:

1. A printing apparatus, comprising:

a printhead substrate;

a plurality of heaters supported by the printhead substrate for firing drops of printing fluid;

a barrier supported by the printhead substrate and defining a plurality of firing chambers over the heaters, the barrier being adapted to change shape;

at least one controller for activating the plurality of heaters and for controlling the shape of the barrier in association with activation of the heaters; and an orifice plate defining a plurality of orifices over the firing chambers, the drops being fired through the orifices.

2. The apparatus of claim 1, wherein the barrier is adapted to change the size of the firing chambers in association with the activation of the heaters.

3. The apparatus of claim 1, wherein the barrier defines channels for feeding printing fluid to the firing chambers, the barrier being adapted to change the size of the channels in association with activation of the heaters to change refill rates of the firing chambers.

4. The apparatus of claim 1, wherein the barrier is formed of a shape-change material.

5. The apparatus of claim 4, wherein the shape-change material is a piezoelectric material.

6. The apparatus of claim 1, wherein each heater comprises a plurality of individually controllable heating elements.

7. The apparatus of claim 6, wherein the controller is adapted to control the size of the firing chambers based on control of the individually controllable heating elements.

8. A fluid ejection device, comprising:

a base;

a layer supported by the base, the layer defining an opening of variable size for containing fluid to be ejected from the fluid ejection device;

a fluid driver supported by the base and adapted to eject fluid drops of different sizes from the fluid ejection device; and at least one controller operably coupled with the layer to adjust the size of the opening and operably coupled with the fluid driver to adjust the size of the ejected drops.

9. The device of claim 8, wherein the fluid driver comprises a plurality of individually controllable resistors.

10. The device of claim 9, wherein the number of individually controllable resistors activated by the controller determines the size of the ejected drops.

11. The device of claim 10, wherein the layer is formed of a piezoelectric material.

12. The device of claim 8, wherein the opening defines a firing chamber for ejecting the fluid.

13. The device of claim 8, wherein the opening defines a channel for feeding fluid for ejection.

14. Apparatus for creating drive bubbles in a variable-size firing chamber, the apparatus comprising:

at least one first resistor adapted for creating a first drive bubble for ejecting a first drop of fluid;

at least one second resistor operably coupled with the first resistor, the first resistor and the second resistor together being adapted for creating a second drive bubble for ejecting a second drop of fluid, the second drop of fluid being larger than the first drop of fluid; and a barrier operably coupled with the first resistor and the second resistor and defining a variable-size firing chamber, the barrier being controlled such that the firing chamber is of a first size for ejection of the first drop and is of a second size for ejection of the second drop, the second size being larger than the first size.

15. The apparatus of claim 14, wherein the barrier is controlled to cover the second resistor when the firing chamber is of the first size.

16. The apparatus of claim 14, in combination with at least one controller for controlling the first resistor, second resistor and barrier.

17. The apparatus of claim 14, wherein the barrier is formed of a piezoelectric material.

18. The apparatus of claim 14, wherein the barrier further defines a variable-size channel for refilling the firing chamber, the barrier being controlled to adjust a rate of refill of the firing chamber via the channel.

19. A method of controlling a printhead, the method comprising:

creating a drive bubble in a firing chamber to eject a drop of printing fluid from the printhead; and changing the size of the firing chamber depending on the size of the drop.

20. The method of claim 19, further comprising using a shape-change material to change the size of the firing chamber.

21. The method of claim 20, further comprising energizing a piezoelectric material to change the size of the firing chamber.

22. The method of claim 19, further comprising changing the size of a channel used to refill the firing chamber.

23. The method of claim 19, further comprising:

creating a first drive bubble in the firing chamber with at least one first resistor;

creating a second drive bubble in the firing chamber with the first resistor and at least one second resistor, the second drive bubble being larger than the first drive bubble; and changing the size of the firing chamber depending on whether the first drive bubble or the second drive bubble is created.

24. The method of claim 19, further comprising covering the second resistor when the first drive bubble is created.

25. The method of claim 24, further comprising energizing a piezoelectric material to change the size of the firing chamber.

26. A method of controlling a printhead, the method comprising:

creating a drive bubble in a firing chamber to eject a drop of printing fluid from the printhead; and changing the size of a refill channel for the firing chamber.

27. A printhead, comprising:

means for creating a drive bubble in a firing chamber to eject a drop of printing fluid from the printhead; and means for changing the size of the firing chamber depending on the size of the drop.

28. The printhead of claim 27, further comprising:

means for creating a first drive bubble in the firing chamber;

means for creating a second drive bubble, larger than the first drive bubble, in the firing chamber; and means for changing the size of the firing chamber depending on whether the first drive bubble or the second drive bubble is created.

29. The printhead of claim 27, further comprising means for changing the size of a refill channel for the firing chamber.

30. An inkjet print cartridge, comprising:

an inkjet print cartridge body;

at least one ink reservoir within the inkjet print cartridge body;

a printhead substrate supported by the inkjet print cartridge body;

a plurality of heaters supported by the printhead substrate for firing drops of ink;

a barrier supported by the printhead substrate and defining a plurality of firing chambers in fluid communication with the reservoir and disposed over the heaters, the barrier being adapted to change shape;

at least one controller for activating the plurality of heaters and for controlling the shape of the barrier in association with the activation of the heaters; and an orifice plate defining a plurality of orifices over the firing chambers, the drops being fired through the orifices.

31. An inkjet printer, comprising:

a printer chassis;

a movement platform supported by the chassis for linear movement;

a feeder for feeding print media;

a printhead substrate supported by the movement platform;

a plurality of heaters supported by the printhead substrate for firing drops of ink;

a barrier supported by the printhead substrate and defining a plurality of firing chambers over the heaters, the barrier being adapted to change shape;

at least one controller for activating the plurality of heaters and for controlling the shape of the barrier in association with the activation of the heaters; and an orifice plate defining a plurality of orifices over the firing chambers, the drops being fired through the orifices.

32. One or more computer-readable media having stored thereon a computer program that, when executed by a processor, causes printhead control according to the following method:

creating a drive bubble in a firing chamber to eject a drop of printing fluid from the printhead; and changing the size of the firing chamber depending on the size of the drop and/or changing the size of a refill channel for the firing chamber.

33. A resistor arrangement for an inkjet printhead, the resistor arrangement comprising:

at least one inner resistor adapted to create a first drive bubble for ejecting a first drop of ink from the inkjet printhead;

at least one outer resistor generally surrounding the inner resistor, the inner resistor and the outer resistor together being adapted to create a second drive bubble for ejecting a second drop of ink from the inkjet printhead, the second drop of ink being larger than the first drop of ink; and first and second switching devices, operably coupled with the inner and outer resistors, for selecting the inner and outer resistors;

wherein the inner resistor and the outer resistor are electrically connected in parallel;

further wherein at least one of the first and second switching devices is electrically connected with a barrier formed of a shape-change material.

* * * * *